US006826996B2

(12) United States Patent
Strait

(10) Patent No.: US 6,826,996 B2
(45) Date of Patent: Dec. 7, 2004

(54) STRUCTURAL COMPOSITE ARMOR AND METHOD OF MANUFACTURING IT

(75) Inventor: S. Jared Strait, Sterling Heights, MI (US)

(73) Assignees: General Dynamics Land Systems, Inc., Sterling Heights, MI (US); Mofet Etzion Agricultural Cooperative Association Ltd. (IL)

( * ) Notice: Subject to any disclaimer, the term of this patent is extended or adjusted under 35 U.S.C. 154(b) by 128 days.

(21) Appl. No.: 10/094,849

(22) Filed: Mar. 11, 2002

(65) Prior Publication Data

US 2003/0167910 A1 Sep. 11, 2003

(51) Int. Cl.[7] ..... F41H 5/04

(52) U.S. Cl. ..... 89/36.02; 89/36.04; 89/36.05; 109/11; 109/12; 109/13; 109/49.5; 109/80; 109/82; 109/84; 428/116; 428/117

(58) Field of Search ..... 89/36.02, 36.04, 89/36.05, 36.01, 36.12, 36.11, 36.17; 109/11, 12, 13, 49.5, 80, 82, 84, 1; 428/116, 117, 214, 218, 293.1, 293.4, 304.4, 313.3, 317.1; 2/456, 455, 411; 156/292

(56) References Cited

U.S. PATENT DOCUMENTS

| | | | | |
|---|---|---|---|---|
| 3,523,057 A | | 8/1970 | Buck | 161/116 |
| 3,616,115 A | * | 10/1971 | Klimmek | 109/84 |
| 3,705,558 A | | 12/1972 | McDougal et al. | 109/84 |
| 3,826,172 A | * | 7/1974 | Dawson | 89/36.02 |
| 4,061,815 A | | 12/1977 | Poole, Jr. | 428/215 |
| 4,131,053 A | | 12/1978 | Ferguson | 89/36 |
| 4,179,979 A | | 12/1979 | Cook et al. | 89/36 |
| 4,198,454 A | | 4/1980 | Norton | 428/117 |
| 4,404,889 A | * | 9/1983 | Miguel | 89/36.02 |
| 4,529,640 A | | 7/1985 | Brown et al. | 428/116 |
| 4,602,385 A | | 7/1986 | Warren | 2/2 |
| 4,683,800 A | * | 8/1987 | Snedeker | 89/36.02 |
| 4,716,064 A | * | 12/1987 | Holzl et al. | 428/73 |
| 4,836,084 A | * | 6/1989 | Vogelesang et al. | 89/36.02 |
| 4,880,681 A | | 11/1989 | Price et al. | 428/116 |

(List continued on next page.)

FOREIGN PATENT DOCUMENTS

| | | | |
|---|---|---|---|
| DE | 101437 | | 9/1897 |
| DE | 1578324 | * | 4/1960 |
| DE | 1142689 | | 2/1967 |
| DE | 1081464 | | 8/1967 |
| DE | 1566448 | * | 5/1969 |

(List continued on next page.)

OTHER PUBLICATIONS

Plasan–Sasa Plastic Products Price Sheet, Kibbutz SASA, M.P. Marom Hagalil, Israel.

(List continued on next page.)

*Primary Examiner*—Michael J. Carone
*Assistant Examiner*—John Richardson
(74) *Attorney, Agent, or Firm*—Brooks Kushman P.C.

(57) ABSTRACT

A composite armor 10 and method for making it. The armor 10 has a honeycomb core 12 that is provided with polygonal openings 14 and oppositely facing sides 16, 18. Inserts 20 are placed within at least some of the openings. A pair of sheets 22, 24 are respectively secured to the oppositely facing sides of the honeycomb core to close the openings, thereby containing fracture debris after impact, and to provide reinforcement. One method of making the composite armor includes: providing a honeycomb core having polygonal openings; adhering a sheet to cover the polygonal openings that are located on one side of the honeycomb core; at least partially filling at least some of the openings with a resin; placing one or more inserts within at least some of the openings; and adhering a front sheet to the oppositely facing side of the honeycomb core. A preferred manufacturing practice involves resin infusion.

16 Claims, 2 Drawing Sheets

U.S. PATENT DOCUMENTS

| | | | | | |
|---|---|---|---|---|---|
| 4,979,425 | A | * | 12/1990 | Sprague | 89/36.02 |
| 5,134,725 | A | | 8/1992 | Yeshurun et al. | 2/2.5 |
| 5,149,910 | A | * | 9/1992 | McKee | 89/36.02 |
| 5,198,282 | A | * | 3/1993 | Baker et al. | 428/114 |
| 5,221,807 | A | * | 6/1993 | Vives | 89/36.02 |
| 5,310,592 | A | * | 5/1994 | Baker et al. | 428/117 |
| 5,349,893 | A | | 9/1994 | Dunn | 89/36.05 |
| 5,361,678 | A | | 11/1994 | Roopchand et al. | 89/36.02 |
| 5,554,816 | A | * | 9/1996 | Skaggs et al. | 89/36.17 |
| 5,763,813 | A | | 6/1998 | Cohen et al. | 89/36.02 |
| 5,804,757 | A | * | 9/1998 | Wynne | 89/36.05 |
| 6,030,483 | A | | 2/2000 | Wilson | 156/292 |
| 6,112,635 | A | | 9/2000 | Cohen | 89/36.02 |
| 6,253,655 | B1 | * | 7/2001 | Lyons et al. | 89/36.02 |
| 6,372,289 | B1 | * | 4/2002 | Hickman | 427/228 |
| 6,575,075 | B2 | * | 6/2003 | Cohen | 89/36.02 |

FOREIGN PATENT DOCUMENTS

| | | | | |
|---|---|---|---|---|
| DE | 1578324 | | | 1/1970 |
| DE | 1352418 | | | 5/1974 |
| DE | 28 15 582 | | | 3/1980 |
| DE | 2815582 | | * | 3/1980 |
| DE | 32 28 264 | A1 | | 12/1985 |
| DE | 3507216 | A1 | | 9/1986 |
| DE | 39 38741 | A1 | | 3/1991 |
| EP | 0 499 812 | A1 | | 8/1992 |
| FR | 816814 | | | 8/1937 |
| FR | 1566448 | | | 3/1969 |
| FR | 2559254 | A1 | | 8/1985 |
| FR | 2 711 782 | A1 | | 5/1995 |
| GB | 2 190 077 | A | | 11/1987 |
| GB | 2 272 272 | A | | 5/1994 |

OTHER PUBLICATIONS

Coors Ceramincs–Materials For Tough Jobs, Coors Porcelain Company.

Navarro, Dr. C. et al., The Performance of Lightweight Ceramic Faced Armours Under Ballistic Impact; Department of Materials Science, Polytechnic University of Madrid, pp. 573–577.

Coors Alumina Armor Materials; Coors Ceramics Company; 1990; Data Sheet 52–96 1–2.

Laible, Roy C., Ballistic Materials And Penetration Mechanics, Methods and Phenomena: Their Applications in Science and Technology, 1980, pp. 135–142, vol. 5, Elsevier Scientific Publishing Company.

Hübner, H., et al., Alumina Processing, Properties, and Applications, 1984, pp. 279–283, Springer–Verlag.

Rafael, System Concept of Applique Flexible Ceramic Armor (FCA); Technical Proposal, Jun. 1993, pp. 3–41.

* cited by examiner

STRUCTURAL COMPOSITE ARMOR AND METHOD OF MANUFACTURING IT

BACKGROUND OF THE INVENTION

1. Field of the Invention

This invention relates to a structural, composite armor for absorbing kinetic energy transferred upon impact by, and limiting penetration by, incident projectiles and a method of manufacturing the composite armor.

2. Background Art

Conventional armor for vehicles calls for the deployment of rigid plates and/or panels that are made from such materials as metallics, ceramics, composites, and the like. Ideally, materials that are used to protect vehicles and their components are light in weight, while affording protection against an oncoming projectile. In operational use, the armor influences an incident projectile so that penetration through the armor plating is avoided. Traditionally, such protective structures prevent the penetration of fragments and debris from the projectile and the material from which the armor is made through any openings created in the rear portions of the armor.

The transfer of kinetic energy occurs through a combination of mechanisms. One occurs where the armor has sufficient thickness and its material is selected so as to impede and present an impenetrable barrier to the incoming projectile. Such an approach, however, involves the adverse consequences of bulk and weight. Another mechanism occurs where the incident projectile is re-routed by eroding, fracturing, or rotating it. A third mechanism involves deforming or bending the incoming projectile so that its impact area is enlarged and the consequent force per unit area is thus diminished.

Such protection mechanisms, however, have yielded mixed results, and the quest for an ideal armor plate—one which has the attributes of rigidity, strength, low density, impact resistance, and ease and favorable cost of manufacturing—continues.

It is known that ceramic tiles bonded to such materials as KEVLAR® as a backing material can be effective against certain armor-piercing bullets. In its broad sense, the term "ceramic" includes certain inorganic materials, except metals and metal alloys. Ceramics may range in form from a vitreous glass to a dense polycrystalline substance. Typically, ballistic ceramics (armor grade ceramics) are brittle and exhibit nearly linear stress-strain curves. Such materials are often characterized by a compressive strength that exceeds tensile strength. Armor grade ceramics include aluminum oxide ($Al_2O_3$), silicon carbide (SiC), silicon nitride (SiN), boron carbide ($B_4C$), and others.

The hardness of ceramics diminishes an incident projectile's penetration by initiating its break-up. After shattering, residual projectile fragments are ideally constrained by the armor-backing materials (debris/spall liners). Thus, the prior art includes ceramic layers that deflect and break incoming projectiles, while the backing materials constrain the residual projectile and fragments.

Illustrative of the prior art are U.S. Pat. Nos. 5,763,813 and 6,112,635 which respectively are assigned to Kibbutz Kfar Etzion and Mofet Etzion. The '813 patent discloses a composite armor material with a panel that consists essentially of a single internal layer of ceramic pellets that are directly bound and retained by a solidified material in superimposed rows. A majority of the pellets is in contact with at least four adjacent pellets. Such approaches lead to inconsistencies in the location of pellet arrays, especially around the edges of the panel and points at which the panel is attached to a substrate which is protected by the armor plate. As a consequence of localized weak points, some anisotropy results. Such approaches also leave opportunities for improvement in multi-hit performance.

It is also known from UK Patent Number 1,142,689, published on Feb. 12, 1969, that other forms of composite light weight armor plate can be effective. That reference discloses energy-dissipating spheres which are embedded in a plastic matrix. Id., ll. 85–90. U.S. Pat. No. 6,112,635 discloses a composite armor plate with a single internal layer of high density ceramic pellets that are retained in plate form by a solidified material. Other prior art references noted during an investigation in connection with the present invention include these United States patents: U.S. Pat. No. 3,577,836 Tamura; U.S. Pat. No. 3,705,558 McDougal et al.; U.S. Pat. No. 4,198,454 Norton; U.S. Pat. No. 4,404,889 Miguel; U.S. Pat. No. 4,529,640 Brown et al.; U.S. Pat. No. 4,880,681 Price et al.; U.S. Pat. No. 5,221,807 Vives; U.S. Pat. No. 5,310,592 Baker et al.; U.S. Pat. No. 5,349,893 Dunn; and U.S. Pat. No. 6,030,483 Wilson.

SUMMARY OF THE INVENTION

It is an object of the invention to provide a structural composite armor that will present to an incident projectile a barrier to entry of any fracture debris through a rear surface of the armor.

More specifically, an object of the invention is to provide a composite armor including a cellular structure with polygonal openings and oppositely facing sides between which the openings extend. Inserts are received by the openings. To close the openings, a pair of sheets are secured to the oppositely facing sides of the cellular structure.

Preferred modes of practicing the invention include its method of making.

The objects, features, and advantages of the present invention are readily apparent from the following detailed description of the best modes for carrying out the invention when taken in connection with the accompanying drawings.

DETAILED DESCRIPTION OF THE PREFERRED EMBODIMENTS

Figure 1:
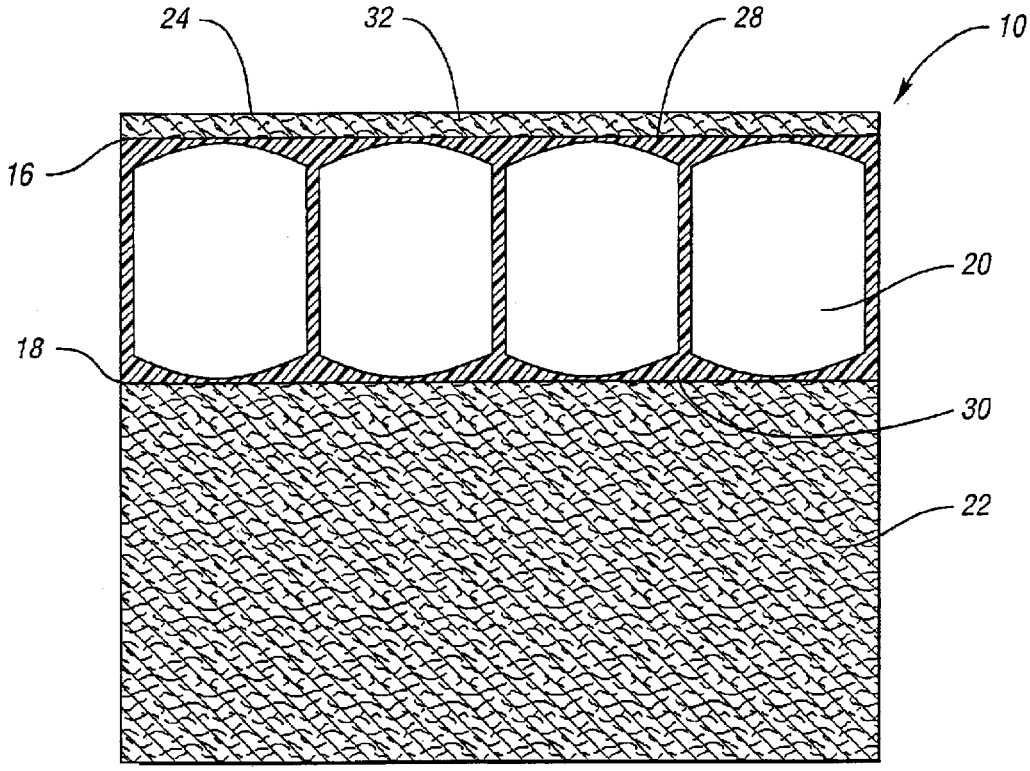
FIG. 1 is a sectional view of a composite armor constructed in accordance with the present invention, taken along the section line 1—1 of FIG. 2.
Figure 2:
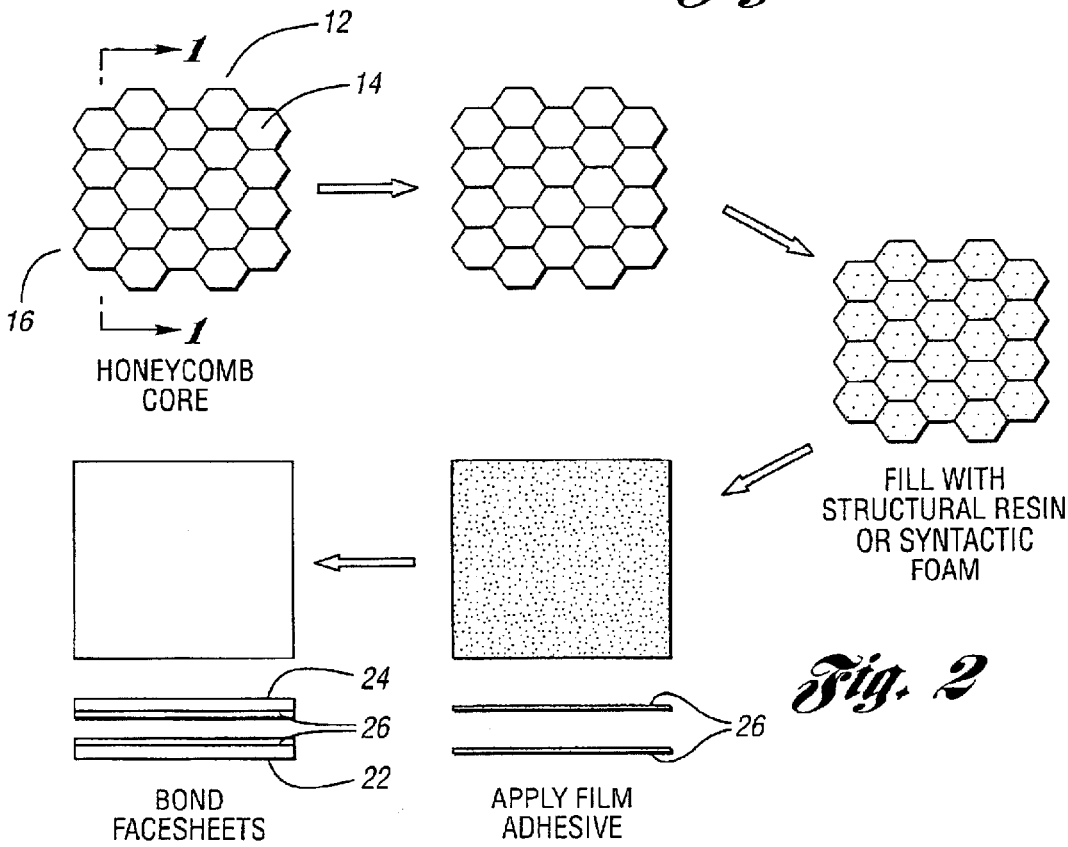
FIG. 2 is a schematic assembly diagram that illustrates the main steps in making the composite armor with inserts received within hexagonal openings in a honeycomb core.

Turning first to FIGS. 1-2, there is depicted a composite structural armor 10 which has a cellular structure, preferably in the form of a honeycomb core 12 with polygonal openings 14 and oppositely facing sides 16, 18 between which the openings 14 extend. More preferably, the polygonal openings 14 are of an hexagonal form. Received within the openings 14 are inserts 20 (FIG. 1) for transforming a projectile's kinetic energy upon impact. A pair of fabric or preform sheets 22, 24 are respectively secured to the oppositely facing sides 16, 18 (FIG. 1) of the cellular structure to close the openings thereof in which the inserts 20 are received to provide chemical, physical and environmental durability, contain fracture debris, and to provide structural reinforcement.

There are several advantages of incorporating a cellular structure into the structural armor. First, it creates a consistent placement of the inserts 20. The designer then knows where each insert is located within the panel because it is structured in such a way that every time he creates a panel using a honeycomb core 12, it spaces the inserts uniformly. Second, the honeycomb core 12 efficiently transfers shear from the durability cover (front face) 24 to the debris/spall liner (back face) 22, thereby, significantly enhancing the bending stiffness of the panel. As a result, unlike the baseline armor disclosed in U.S. Pat. No. 5,763,813, the honeycomb panel is able to carry structural loads. Third, the cells of the honeycomb completely isolate adjacent inserts. In the baseline armor, adjacent inserts are in intimate contact. When the baseline armor is impacted, a shock wave propagates through multiple inserts around the area of impact until the matrix material that binds the inserts attenuates that shock wave. Using a honeycomb with a dissipative resin system to completely isolate the inserts, the shock wave is attenuated much sooner and the resulting number of damaged inserts is reduced. This improves the multi-hit performance of the armor system.

Each insert 20 is preferably made of a ceramic and has an intermediate portion 26. In one embodiment, the insert 20 has a main body portion that is of a rounded shape. In a further preferred embodiment, the opposite ends 28, 30 are generally convex and are respectively located adjacent the pair of oppositely facing sides 16, 18 of the cellular structure (FIG. 1).

In one embodiment, the honeycomb core 12 is made of a material selected from the group consisting of stainless steel, aluminum, an aramid sheet, fiber or fabric such as that sold under the trademark NOMEX® by DuPont of Richmond, Va., phenolic resins, and similar materials.

In an alternate embodiment, the composite armor includes a filler that is received within the openings 14 of the cellular structure 12, the inserts 20 being embedded within the filler. Preferably, the filler is selected from the group consisting of resins and foams, and most preferably is a resin.

As depicted in FIG. 2, in an alternative embodiment, the pair of sheets 22, 24 is secured to the oppositely facing sides 16, 18 of the cellular structure 12 by an adhesive 26. The front sheet 24 typically is exposed to the environment and consists of a protective or durability layer. The opposite internal sheet 22 is the primary structural laminate. It incorporates a spall/debris liner. The outer durability layer 24 is thin in relation to the inner layer or structural laminate 22 with a spall liner.

Continuing with reference to FIGS. 1-2, there is illustrated a method of manufacturing the structural armor. First, inserts 20 are aligned in a unit cell configuration using a cellular structure, such as a honeycomb core 12. Preferably, the unit cell has dimensions that correspond to a regular hexagon. In one alternative method, the honeycomb core 12 is then filled with a structural resin system. This serves the purpose of providing a shear transfer material in addition to the honeycomb core, as well as to fill any gaps, thereby ameliorating any moisture absorption, nuclear, biological, chemical, hardness, or decontamination issues. In an alternative method, a lightweight syntactic foam is incorporated in place of the structural resin to further reduce the density of the resulting composite armor. In another embodiment, no resin or structural foam or equivalent material occupies interstitial spaces.

The filled honeycomb core 12 is then bonded to composite face sheets 22, 24 (FIG. 2) or is co-cured with the face sheets using a high strength adhesive such as FM73K, which is available from Cytec Industries located in West Paterson, N.J.

The face sheets 22, 24 can vary in thickness, depending on the need for durability covers or spall and/or debris liners.

Figure 3:
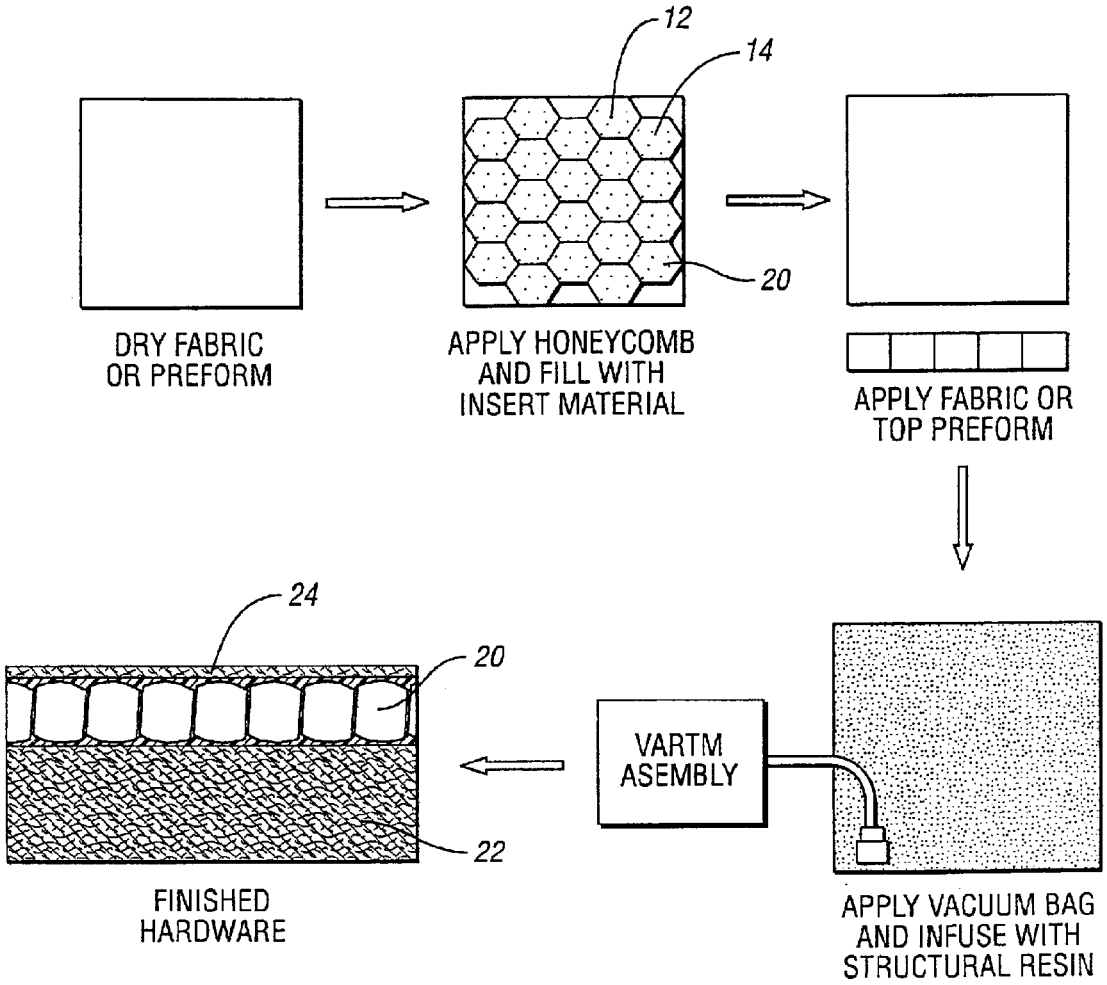
FIG. 3 is a schematic assembly diagram of an alternative method of making the subject invention.

An alternative, but preferred processing approach is depicted in FIG. 3. This approach offers the additional manufacturing efficiency that accompanies a Vacuum-Assisted Resin Transfer Molding (VARTM) approach to panel infusion. The VARTM process infuses resins into the fiber preforms using relatively inexpensive, one-sided tooling and vacuum pressure.

In this process (FIG. 3), fiber preforms (or plies of fabric) are placed into a one-sided tool. A honeycomb material is applied to the preform and is filled with the insert material. Additional layers of fabric (or another preform) are then applied to the top surface of the panel. The entire assembly is then vacuum-bagged and infused with structural resin using the VARTM process.

This process enables spall or debris liners to be simultaneously infused, and reduces the need for additional adhesives or mechanical fasteners. In addition, this approach offers the benefits of structural performance, together with improved environmental and chemical resistance over prior art approaches. Furthermore, the structural armor can be machined using a standard abrasive cutting wheel. This provides the opportunity to machine finished product geometries from large, easily produced panels.

Initial structural and ballistic testing has demonstrated the viability of the disclosed methods to not only replace conventional applique panels, but also can be implemented in future vehicles as ballistic composite structures.

Thus, the invention includes a controlled cellular structure that provides a uniform spacial distribution of impact-absorbing media that is relatively isotropic. In the cellular structure, there are minimal inconsistencies in the locations of the arrays of inserts. When the composite armor panel is attached to a substrate for protection, attachment points at which, for example, bolt holes are provided, can be located through one or more of the hexagonal openings in the cellular structure.

As a result of the ductile-brittle transition referenced earlier, the shock wave that results from impact is attenuated in a plane that lies orthogonal to the impacting force (in the plane of the armor, as opposed to through its thickness). As a result, fewer adjacent inserts are damaged, in part because there is no direct contact between adjacent inserts since they are separated by the ductile cellular structure. Consequently, multi-hit performance is also improved.

While embodiments of the invention have been illustrated and described, it is not intended that these embodiments illustrate and describe all possible forms of the invention. The words used in the specification are words of description rather than limitation, and it is understood that various changes may be made without departing from the spirit and scope of the invention.

What is claimed is:

1. A composite armor comprising:

a cellular structure having polygonal openings and oppositely facing sides between which the openings extend;

a plurality of ceramic inserts that are bounded by convex surfaces and are respectively received by the polygonal openings of the cellular structure such that the inserts individually are spaced and isolated from each other and so that there is one insert in a given opening; and a pair of sheets respectively secured to the oppositely facing sides of the cellular structure to close the openings thereof, thereby providing chemical, physical, and environmental durability, containing fracture debris after impact, and providing structural reinforcement.

2. A composite armor as in claim 1 wherein the cellular structure is made of a material selected from the group consisting of stainless steel, aluminum, an aramid fiber, phenolic resins and the like.

3. A composite armor as in claim 1 wherein at least some of the inserts have an intermediate portion having a rounded shape, and a pair of opposite ends of a convex shape respectively located proximate to the pair of oppositely facing sides of the cellular structure.

4. A composite armor as in claim 1 further including a filler that is received within the openings of the cellular structure, the inserts being embedded within the filler.

5. A composite armor as in claim 4 wherein the filler is selected from the group consisting of resins, foams and the like.

6. A composite armor as in claim 1 wherein the cellular structure comprises a honeycomb structure.

7. A composite armor as in claim 1 wherein at least some of the inserts comprise a material selected from the group consisting of aluminum oxide, boron carbide, silicon carbide, silicon nitride, a metal, and mixtures thereof.

8. A composite armor as in claim 1 wherein at least one of the pair of sheets comprises a material selected from the group consisting of a metal cover, a plastic, a reinforced composite, and mixtures thereof.

9. A composite armor as in claim 1 wherein the pair of sheets comprise a durability cover attached to an outer face of the cellular structure and an internal sheet attached to an inner face of the cellular structure, the internal sheet comprising one or more primary structural laminates and one or more spall/debris liners.

10. A composite armor as in claim 1 further comprising an adhesive that secures the pair of sheets to the oppositely facing sides of the honeycomb core.

11. A composite armor comprising:

a cellular structure having hexagonal openings and oppositely facing sides between which the openings extend;

a plurality of ceramic inserts that are bounded by convex surfaces and are respectively received by the hexagonal openings, at least some of the inserts having an intermediate portion, and having a pair of opposite convex ends of rounded shapes respectively located adjacent the pair of oppositely facing sides of the cellular structure; and a pair of non-metallic sheets respectively secured to the oppositely facing sides of the cellular structure to close the openings thereof.

12. A composite armor comprising:

a cellular structure having hexagonal openings and oppositely facing sides between which the openings extend;

a plurality of ceramic inserts that are bounded by convex surfaces and are respectively received by the hexagonal openings, at least some of the inserts having an intermediate portion of a cylindrical shape, and each insert having a pair of opposite convex ends of rounded shapes respectively located adjacent the pair of oppositely facing sides of the cellular structure;

a filler received within the openings of the honeycomb core with the ceramic inserts embedded within the filler; and a pair of non-metallic sheets respectively secured to the oppositely facing sides of the cellular structure to close the openings thereof in which the inserts are received and embedded within the filler to provide reinforcement.

13. A composite armor comprising:

a cellular structure that is made of a material selected from the group consisting of stainless steel, aluminum, an aramid fiber, and phenolic resins and that has hexagonal openings and oppositely facing sides between which the openings extend;

a plurality of inserts that are bounded by convex surfaces and are respectively received by the hexagonal openings, at least some of the inserts comprising a material selected from the group consisting of aluminum oxide, silicon carbide, silicon nitrite, boron carbide, and mixtures thereof, at least some of the inserts having an intermediate portion of a cylindrical shape, and having a pair of opposite convex ends of rounded shapes respectively located adjacent the pair of oppositely facing sides of the cellular structure;

a filler selected from the group consisting of resins and foams and being received within the openings of the honeycomb core with the ceramic inserts embedded within the filler; and a pair of non-metallic sheets respectively bonded to the oppositely facing sides of the cellular structure to close the openings thereof in which the inserts are received and embedded within the filler to provide reinforcement.

14. A method for making composite armor as claimed in claim 1, comprising the steps of:

providing a fiber preform as an internal structural laminate/spall liner that is placed into a one-sided tool;

applying a cellular structure to the preform;

filling the cellular structure at least partially with an insert material;

applying one or more layers of fabric as an external durability cover, thereby forming a structural composite armor atop the cellular structure; and infusing the assembly with a structural resin, thereby simultaneously infusing the durability cover, cellular structure, and structural laminate/debris space liner.

15. A method for making a composite armor as claimed in claim 1, comprising steps of:

providing a honeycomb care having polygonal openings;

adhering a rear sheet to cover the polygonal openings that are located on one side of the honeycomb core;

at least partially filling at least some of the openings with a resin;

placing one or more inserts within at least some of the openings; and adhering a front sheet to the oppositely facing side of the honeycomb core.

16. A method for making a composite armor as claimed in claim 1, comprising the steps of:

providing a layer of fabric as an external durability cover that is placed into a one-sided tool;

applying a cellular structure to the layer of fabric;

filling the cellular structure at least partially with an insert material;

applying one or more fiber preforms as an internal structural laminate/spall liner atop the cellular structure; and infusing the assembly with a structural resin, thereby simultaneously infusing the durability cover, cellular structure, and structural laminate/debris spall liner.

* * * * *

UNITED STATES PATENT AND TRADEMARK OFFICE

CERTIFICATE OF CORRECTION

PATENT NO. : 6,826,996 B2
DATED : December 7, 2004
INVENTOR(S) : S. Jared Strait It is certified that error appears in the above-identified patent and that said Letters Patent is hereby corrected as shown below:

Column 6,
Line 45, delete “care” and insert therefor -- core --.

Signed and Sealed this

Nineteenth Day of April, 2005

JON W. DUDAS
*Director of the United States Patent and Trademark Office*